US005899166A

United States Patent [19]

Alexander et al.

[11] Patent Number: 5,899,166

[45] Date of Patent: May 4, 1999

[54] BOAT HULL PROTECTOR

[75] Inventors: Robert G. Alexander; JoAnn F. Alexander; David M. Zakarian; Carolyn H. Zakarian, all of Salem, Oreg.

[73] Assignee: Twin Lakes Incorporated, Salem, Oreg.

[21] Appl. No.: 09/069,894

[22] Filed: Apr. 29, 1998

[51] Int. Cl.[6] ..... B63B 17/00

[52] U.S. Cl. ..... 114/361; 114/219

[58] Field of Search ..... 114/219, 343, 114/361

[56] References Cited

U.S. PATENT DOCUMENTS

| | | | |
|---|---|---|---|
| D. 370,657 | 6/1996 | Block, Jr. | D12/317 |
| 4,815,412 | 3/1989 | Cassaro, Jr. | 114/219 |
| 4,962,719 | 10/1990 | Hughes et al. | 114/343 |
| 5,076,195 | 12/1991 | Heyne | 114/361 |
| 5,398,631 | 3/1995 | Miller | 114/219 |
| 5,564,358 | 10/1996 | Newton | 114/361 |

*Primary Examiner*—Jesus D. Sotelo

*Attorney, Agent, or Firm*—Klarquist Sparkman Campbell Leigh & Whinston, LLP

[57] ABSTRACT

A protector for the bow portion of a boat hull consists of a sheet having a rear-opening pocket adapted to engage the prow of the boat. When in use, the sheet extends rearwardly from the prow, covering the center portion of the boat hull. Lines are attached at one end to the rear-most portion of the sheet, and are adapted to be secured to the boat at the other end. A weight and a forward-opening scoop pocket are located at the rear of the sheet. The sheet is secured to the boat by placing the rear-opening pocket over the prow of the boat, dropping the remainder of the sheet into the water below the prow so that the weight causes the rear of the sheet to sink below the prow, propelling the boat forward so that the scoop pocket fills with water and pulls the sheet along the hull toward the stern of the boat, retrieving the lines from the water and securing the lines to the boat. Floats are attached to the lines so that the lines may be easily retrieved from the surface of the water.

9 Claims, 3 Drawing Sheets

5
5
6
6
30
32
32
37
37
46
44
49
49
48
48
36
38
43
43
43
43
43
43
43
43
39
40B
62
62
72
72
70
70
60
54
54
52
51
34
50
60
34
54
40A
61
36
40B
42
58
51
59
52
50

BOAT HULL PROTECTOR

The present invention relates to a protector for a boat hull. More specifically, the invention relates to a protector for the bow portion of a boat hull while the boat is beached.

BACKGROUND OF THE INVENTION

Boats are often beached at shorelines between periods of use. Typically when beaching a boat, the bow end of the boat hull comes to rest on the shoreline. Shorelines are often dotted with obstructions such as small rocks and gravel. Thus, when the boat hull is approaching, resting on, or moving away from the shoreline, the hull is often damaged by contact with the shoreline and its obstructions. Scratches and other damage caused by this contact with the shoreline are unsightly, costly to repair, interfere with the operation of the boat, and thus decrease the resale value of the boat. Therefore, there is a need for a device to protect the hull of a boat when it is beached.

Past protective devices have been difficult to secure and remove while a boat is waterborne. Many such devices have been secured to the eye of a boat during use. The eye is typically located well below the deck near the prow of the boat, and is thus difficult to reach. Past covers have also been bulky and difficult to store when not in use.

Moreover, past protective devices have allowed dirt and rocks to be washed between the hull and the cover. While the boats were beached, the protective covers were not held tightly against the hulls of the boats. Thus, while such boats are beached and when such boats are being backed away from shorelines, these prior devices allow the hull to be damaged by the rocks and dirt that have become wedged between the cover and the hull.

SUMMARY OF THE INVENTION

An object of the present invention is to provide a boat hull protector that protects the hull of a boat when the boat is beached and overcomes problems associated with previous boat hull protectors.

More specifically, an object of the present invention is to provide a boat hull protector consisting of a protector sheet that is easily secured to and removed from the boat, and that is held tightly against the hull of the boat while in use.

This disclosure discusses new protection systems for boat hulls. Several different inventions and several variations of inventions are described. In one such invention, a boat hull protector has a sheet of protective fabric, a rear-facing pocket on one end adapted to fit over the prow of the boat, a forward-facing scoop pocket on the other end adapted to act as a sea anchor, a weight secured to the sheet near the scoop pocket, and fasteners attached to opposing sides of the sheet near the scoop pocket.

Another of the inventions is a method of securing a boat hull protector to a boat while the boat is waterborne. The method includes placing the rear-facing pocket of a protector over the prow of the boat, dropping the protector into the water, such that a weight secured to the protector on the end opposite the rear-facing pocket causes the protector to sink below the hull of the boat, moving the boat forward such that the front-facing pocket located near the weight fills with water and drags the main body of the protector rearwardly along the hull beneath the boat, retrieving fasteners attached to opposing sides of the protector near the weight and securing the fasteners to the boat, thus holding the sheet tightly against the hull of the boat.

Other inventions and variations of inventions will be apparent from the drawings and following detailed description.

DESCRIPTION OF PREFERRED EMBODIMENT

Figure 1:
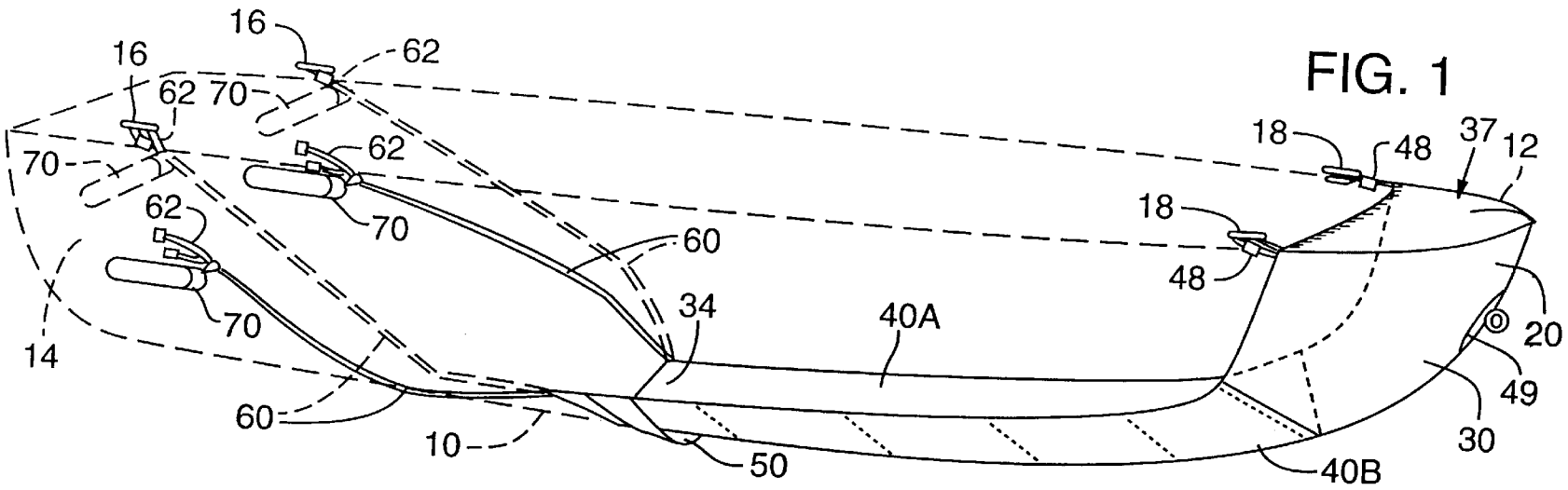
FIG. 1 is an oblique view of a preferred embodiment of a boat hull protector, shown in position on a boat before attachment lines are secured.

FIG. 1 shows the outline of a typical boat hull 10 having a bow end 12 and a stern end 14. Cleats or mooring anchors 16, 18 are positioned along the top of the boat hull 10. The forward-most portion of the bow end 12 comes to a point to form a prow 20. During operation, it is often desirable to beach the boat on a shoreline. The present invention relates to a protector for the bow end 12 of the hull 10 of the boat during beaching.

The illustrated protector is made of a sheet 30 having a first end 32 and a second end 34, a top surface 35 and a bottom surface 36. The sheet 30 may be any shape and has dimensions sufficient to incorporate the features described herein, and to cover the portion of the hull 10 which ordinarily contacts the shoreline during beaching. In a preferred embodiment (see FIG. 5), the first end 32 of the sheet 30 is shaped to form a rear-opening cup 37 which serves as a prow-engaging pocket. The pocket 37 is adapted to engage the prow 20 of the boat (see FIG. 2).

The sheet 30 has a center portion 38 that tapers toward the second end 34, and a rear portion 39 which is substantially rectangular. The width of the second end 34 is approximately one third the width of the cup 37 measured horizontally at the widest location when the protector is installed on a boat. In one embodiment of the invention for boats approximately 15–25 feet in length, the maximum width of the first end 32 is fifty-three inches, the width of the second end 34 is nineteen inches and the overall length is one hundred twenty-six inches. It should be appreciated that when the sheet 30 is in tension on a boat, these dimensions will be increased at the first end 32 of the protector. A single size sheet 30 may be used for a range of boat sizes and shapes, but the dimensions will vary if the size or shape of the boat exceeds that range. One or more openings 49 are provided in the sheet 30 at the first end 32 to allow access to fittings, such as the eye which is commonly provided to secure a bow line.

The materials used in the protector should be selected to resist mold and rotting, since the protector frequently is exposed to water. Preferably the entire sheet 30 is flexible so that it will adapt to the shape of the boat and will be easily stored. In the illustrated embodiment the cup portions 37 and center portion 38 of the protector sheet 30 consist of a nylon material, such as rip-stop nylon, which has a high degree of wear resistance. These portions of the protector are not normally submerged when the protector is in place on a boat. The rear portion 39 of the protector sheet 30 should consist of materials that are sufficiently tough to prevent rocks and other obstructions from penetrating the rear portion 39 during beaching. However, if a material is used that is not sufficiently tough, the thickness can be increased or a multi-layer construction may be used to compensate.

Figures 4, 5, 6:
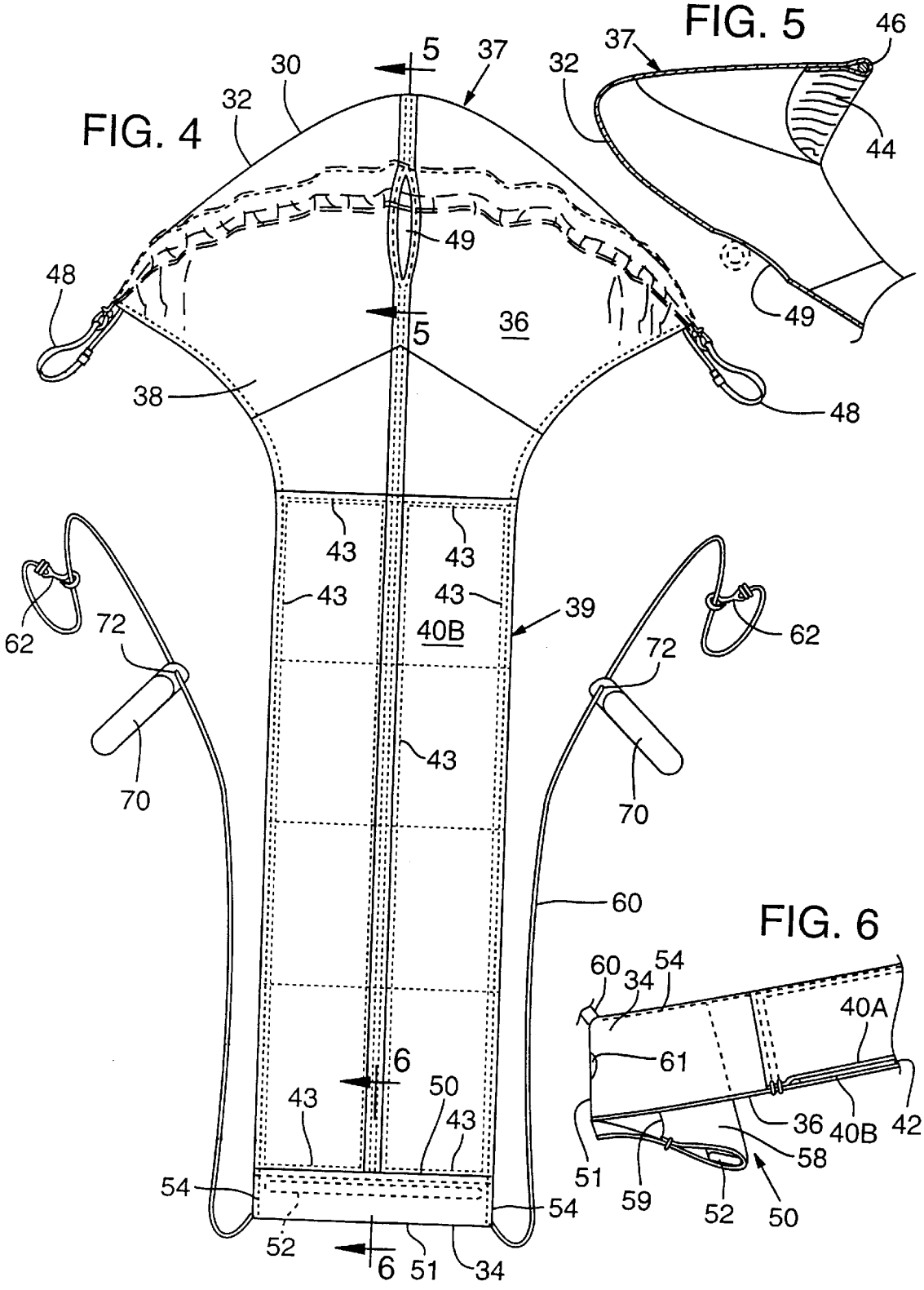
FIG. 4 is an enlarged bottom plan view of the protector of FIG. 1 before installation on a boat.
FIG. 5 is an enlarged sectional view taken along line 5—5 of FIG. 4.
FIG. 6 is an enlarged, oblique sectional view taken along line 6—6 of FIG. 4.

Referring to FIGS. 4 and 6, most of the rear portion 39 of the sheet 30 is a sandwich which includes two outer sheets 40A, 40B centered on the longitudinal axis A of the sheet 30. The sheets 40A, 40B are stitched together along seams 43 to define compartments therebetween, but other means of attaching it may be used. The sheets 40A, 40B may be made of the same material as other portions of the sheet 30, or may be made of some other material that is sufficiently tough and that resists mold and rotting. Best results are achieved when the sheets 40A, 40B are sheets of a ballistic material. The portion 39 is of a shape and size such that it covers the area of the boat that will most likely contact the shoreline. In a preferred embodiment, the sheets 40A, 40B are rectangular in shape, the length of the sheet 40A being slightly less than the length of the rear section 39.

Sandwiched between the sheets 40A, 40B is a layer of cushioning material, preferably a 1/16 inch thick elastic neoprene material, to provide cushioning between the boat hull and the shoreline. The layer of cushioning material is best formed from multiple panels, such as the two illustrated panels or sheets 41, 42 that are each about four feet long. For convenience of manufacture, the layer of cushioning material can comprise even more panels. For example, the layer of cushioning material could comprise two three-foot long panels arranged end-to-end on each side of the longitudinal axis A. Or, the layer could comprise four two-foot long panels arranged end-to-end on each side of the longitudinal axis A. Best results are achieved when each panel of cushioning material is held in a separate compartment defined between the sheets 40A, 40B by stitched seams, such as the seams 43. The panels should be dimensioned to fill the compartments, but not be so large that stitching at the seams 43 extends through the panels. The longitudinal seam between the two illustrated sheets 40, 42, prevents the sheets from migrating laterally. Transverse seams prevent the panels from migrating longitudinally. The sheets 40A, 40B and neoprene cushion panels together provide a hull protector which has a long useful life and which gives substantial protection to the hull 10.

As shown in FIG. 5, a reverse bend at the first end 32 of the sheet 30 bends toward the top surface of the sheet 30 to form the engaging pocket 37. A folded portion 44 extends along the edge of the engaging pocket 37, and is fastened back into the material of the engaging pocket, preferably by stitching. However, any of several fastening means are sufficient. The folded portion 44 houses a tightening line 46 which extends through the length of the folded portion and which has free end portions 47 which extend outwardly from the sheet 30 as portions of attachment loops 48 which are used to secure the sheet 30 to cleats near the front of the boat. In the illustrated embodiment, each attachment loop 48 also comprises a strap 53 which extends from the sheet 30 to a snap-link assembly which includes a female fastener receptacle 55 that receives a spring-loaded buckle 57. The buckle 57 defines slots through which a cinch strap 61 is laced. The straps 53 and 61 are made of one-inch nylon webbing. A D-ring 63, located at one end of cinch strap 61, is adapted to receive a spring-locked clamp 64 attached to the adjacent free end portion 47 of the tightening line 46 so that when the D-ring 64 engages the clamp 64 the loop 48 is completed. The circumference of the loops 48 may be adjusted by shortening or lengthening the cinch strap 61 between the buckle 57 and the D-ring 63, thus adjusting the effective length of the tightening line 46. Alternatively, two separate tightening lines may be respectively attached to each of the opposite sides of the engaging pocket 37, rather than the illustrated continuous tightening line.

A scoop pocket 50 is formed at the second end 34 of the sheet 30 on the bottom surface 36. The scoop pocket 50 is adapted to catch water like a sea anchor to pull the sheet 30 under the boat. Referring now to FIG. 6, in a preferred embodiment, a reverse bend or fold 51 in the sheet 40B at the second end 34 of the sheet 30 provides an area of fabric which extends back along the bottom surface 36 of the sheet 30. Opposing edges of the reverse bend are fastened back to the sheet 40B to form a scoop pocket 50. Preferably, stitching along side seams 54 attaches the reverse bend back to the sheet 40B, but any of several fastening means are sufficient.

Referring still to FIG. 6, a weight 52 is incorporated into the sheet 30 at the second end 34. In a preferred embodiment, another reverse bend or fold is provided at the leading edge of the scoop pocket 50. With this arrangement, an area 58 of fabric extends back from the fold and is fastened to form a compartment which contains the weight 52. The area 58 may be fastened by any sufficient means. Preferably the area 58 of fabric is stitched along its transverse edge 59, and its side edges are secured at the seams 54. The weight 52 may consist of any of several heavy materials, such as a lead bar. An opening 61 is provided at the rear of the scoop pocket 50 so that some water can flow out of the pocket through the opening while the boat is moving forward; this helps to reduce drag and to reduce stress on the pocket 37 when the boat is moving forward.

Figure 2:
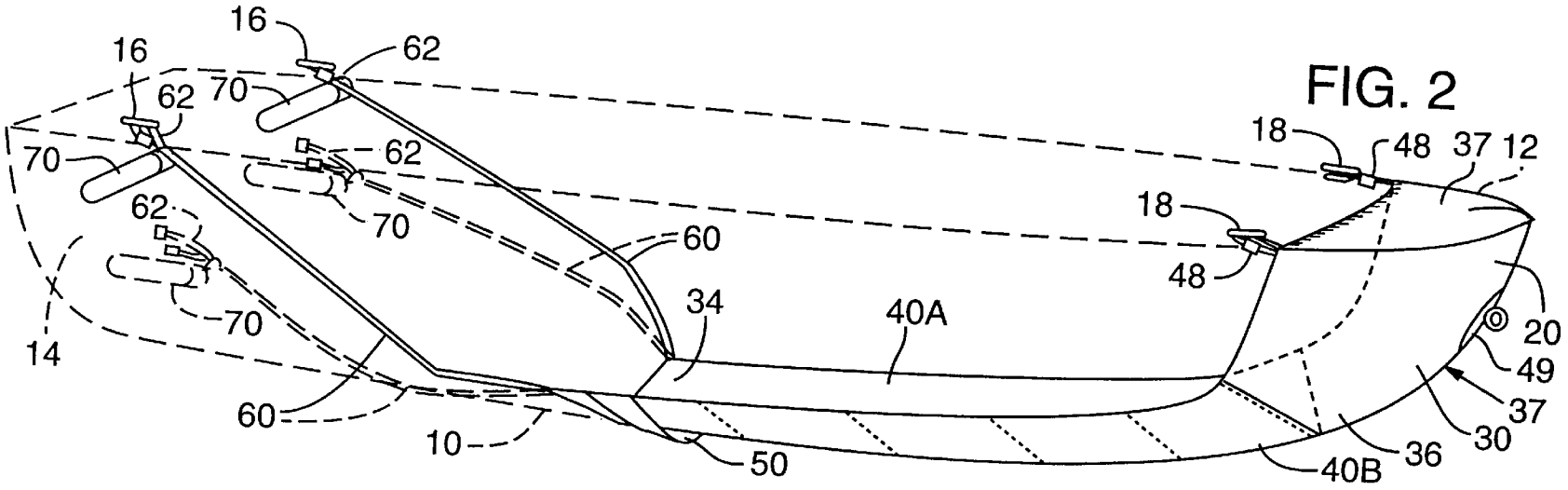
FIG. 2 is an oblique view of the protector of FIG. 1 after the attachment lines are secured.

As shown in FIG. 2, fasteners secure the second end 34 of the sheet 30 to the boat while in use. In a preferred embodiment, the fasteners are securing lines 60. The securing lines 60 may consist of any material that is sufficiently strong, light and is able to be secured to the boat. In the illustrated embodiment, the securing lines 60 are elastic "shock" or "bungee" cords. Alternatively, the lines 60 can be one-inch nylon webbing. The securing lines 60 are secured to opposing sides of the second end 34 of the sheet 30 distal from the first end 32. The securing lines 60 may be attached to the sheet 30 by any available means. In the illustrated embodiment the securing lines 60 are stitched to the sheet 30. The securing lines 60 form adjustable loops 62 distal from the sheet 30 (see FIG. 4). The user may vary the overall length of the securing lines 60 by adjusting the circumference of the loops 62 (as the circumference increases the overall length of the lines decreases). Referring back to FIG. 4, floats 70 may be attached to the securing lines 60.

Figure 3:
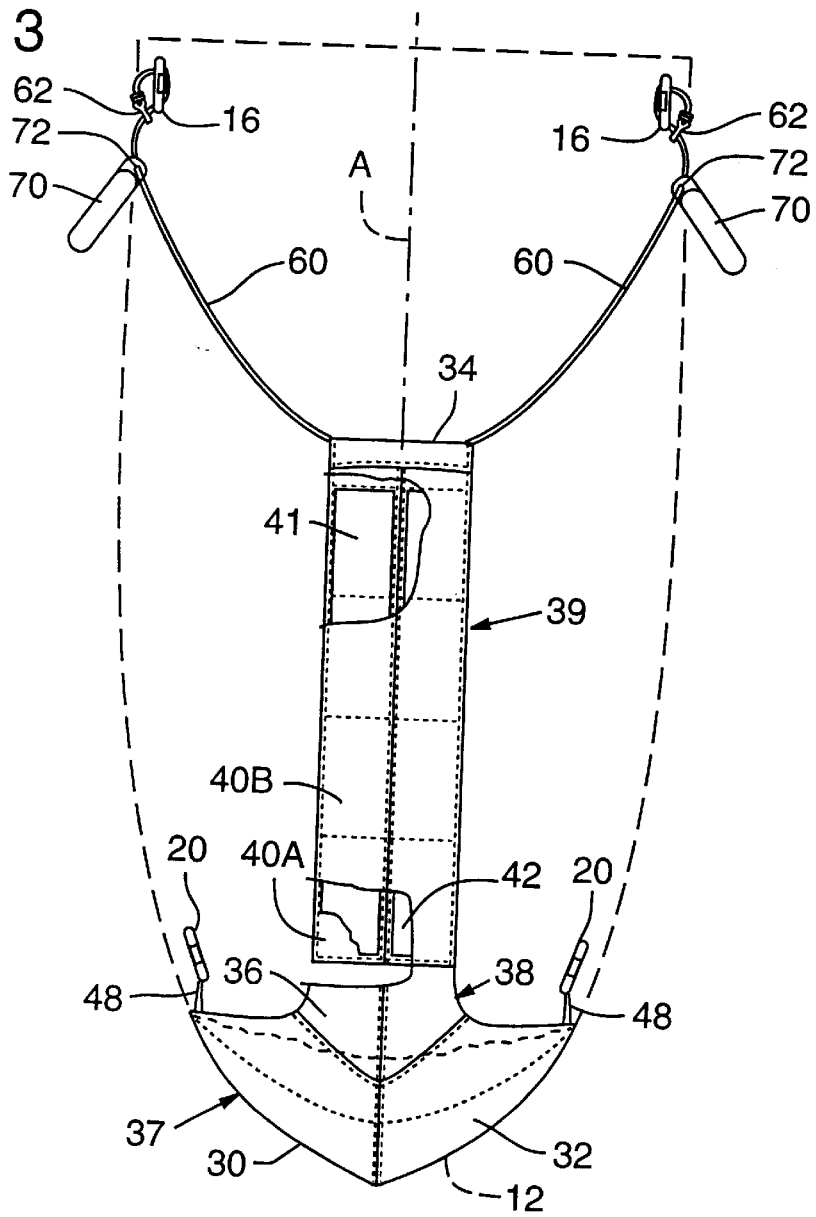
FIG. 3 is a bottom plan view of the boat hull protector of FIG. 1 secured to the boat.
Figure 7:
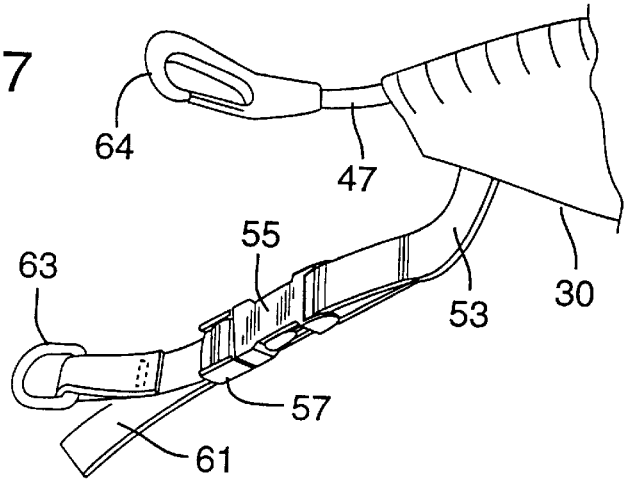
FIG. 7 is an enlarged oblique view of a fastener system used with the protector of FIG. 1.

Referring now to FIG. 2, when the boat hull protector is in use, the engaging pocket 37 is disposed over the prow 20 of the boat. The protector sheet 30 extends rearwardly therefrom along the hull 10 of the boat. Thus, the protector sheet 30 covers the bottom portion of the bow end 12 of the boat hull 10 (best seen in FIG. 3). At the rearmost portion of the protector sheet 30, fasteners secure the sheet to the boat. In the illustrated embodiment, the fasteners include the securing lines 60 that extend rearwardly and upwardly from the starboard and port sides of the second end 34 of the sheet, and the ends of the securing lines 60 distal from the sheet 30 are secured to the boat. Thus, the fasteners create a rearward and upward force and the engaging pocket 37 creates a forward and upward force. The upward forces of the engaging pocket 37 and the fasteners hold the sheet 30 tightly against the hull 10 of the boat, and the opposing rearward and forward forces keep the sheet in a tensioned state, holding the sheet tightly in place. The engaging pocket 37, the sheet 30 and the securing lines 60 must be of sufficient strength to withstand the tension that is sustained by the protector while in operation. Because the sheet 30 is tensioned and is held tightly against the hull 10 of the boat, rocks and dirt are not able to wash between the sheet and the hull 10 of the boat while the boat is beached.

To use the boat hull protector most effectively, a user secures the protector to the boat before beaching while the boat is waterborne and the user is standing in the boat. The protector remains secured during the time when the boat is beached. After the boat is relaunched, a user in the boat removes and stores the protector while the boat is again waterborne.

To secure the protector to the boat, the user secures the floats 70 to the securing lines 60 if they are not already attached. The user then places the loops 48 at opposing ends of the tightening line 46 over the adjacent cleats 18 and places the engaging pocket 37 over the prow 20 of the boat. The user subsequently drops the second end 34 of the protector sheet 30 into the water below the prow 20 with one of the floats positioned on each side of the longitudinal axis of the hull. The weight 52 causes the second end 34 of the protector sheet 30 to sink below the hull 10 of the boat. The user then propels the boat forward. As the boat moves forward, the scoop pocket 50 fills with water and drags the second end 34 of the sheet 30 rearwardly toward the stern end 14 of the boat along the hull 10 of the boat, as shown in FIG. 1. The user then retrieves the float 70 attached to one of the securing lines 60, and secures the line to the boat by attaching the securing line to an anchor point on the boat. In the illustrated embodiment, this is done by placing the loop 62 over a cleat 16 located rearwardly from the sheet 30 (see FIG. 2). The same procedure is repeated for the other securing line 60.

The boat may then be beached. While the boat is beached, the protector keeps rocks and dirt from contacting the hull 10 of the boat.

To remove the protector, the securing lines 60 should be removed from the boat while the boat is beached. This is accomplished by removing the loops 62 from the cleats 16. Next the boat is backed off the beach. As the boat moves away from he beach, the protector slides forward along the hull until it below or in front of the bow. The user, standing near the bow of the boat, then pulls the protector upwardly into the boat beginning with the first end 32 and removes the loops 48 on the tightening line 46 from the cleats 18. The protector may then be folded or rolled up, and stored on the boat during use.

Although the invention is described herein with reference to the preferred embodiment, one skilled in the art will readily appreciate that other applications and features may be substituted for those set forth herein without departing from the spirit and scope of the present invention. Accordingly, the invention should only be limited by the claims below.

We claim:

1. A boat hull protector comprising:

a sheet for covering the bow end of the boat hull, the sheet having a first end, a second end, a top surface, and a bottom surface, the sheet defining a prow-receiving pocket that opens toward the second end, the pocket being adapted to receive and engage the prow of the boat;

securing lines attached to the sheet near the second end for securing the second end to the boat, the securing lines being sufficiently long that, when the protector is in position on a boat, the securing lines can extend rearwardly and upwardly to anchor points that are on the boat distal from the sheet such that the sheet is held tightly against the hull of the boat by the engaging pocket and the securing lines; and floats attached to the securing lines distal from the flexible sheet, such that when the second end of the flexible sheet is dropped into the water, the floats keep the lines at the water surface.

2. A boat hull protector comprising:

a sheet for covering the bow end of the boat hull, the sheet having a first end, a second end, a top surface, and a bottom surface, the sheet defining a prow-receiving pocket that opens toward the second end, the pocket being adapted to receive and engage the prow of the boat; and fasteners attached to the sheet near the second end for securing the second end to the boat, such that the sheet is held tightly against the hull of the boat by the engaging pocket and the fasteners; and a weight attached near the second end, the weight being sufficient that the second end sinks when in water.

3. A boat hull protector comprising:

a sheet for covering the bow end of the boat hull, the sheet having a first end, a second end, a top surface, and a bottom surface, the sheet defining a prow-receiving pocket that opens toward the second end, the pocket being adapted to receive and engage the prow of the boat;

securing lines attached to the sheet near the second end for securing the second end to the boat, the securing lines being sufficiently long that, when the protector is in position on a boat, the securing lines can extend rearwardly and upwardly to anchor points that are on the boat distal from the sheet such that the sheet is held tightly against the hull of the boat by the engaging pocket and the securing lines;

floats attached to the securing lines distal from the flexible sheet, such that when the second end of the flexible sheet is dropped into the water, the floats keep the lines at the water surface; and a scoop pocket at the bottom surface of the sheet near the second end, the pocket being forward-opening such that when the boat moves forward with the prow of the boat received in the prow-receiving pocket, the scoop pocket is filled with water, and pulls the second end toward the stern end of the boat.

4. A boat hull protector, comprising:

a flexible sheet having a first end, a second end, a top surface, and a bottom surface, the first end defining a prow-engaging pocket that opens toward the second end to receive the prow of the boat;

a weight attached near the second end, the weight being sufficient that the second end sinks when in water;

a scoop pocket at the bottom surface of the sheet near the second end, the pocket being forward-opening such that when the boat moves forward with the prow of a boat received in the prow-receiving pocket, the scoop pocket is filled with water, and pulls the second end toward the stern end of the boat; and securing lines that are attached to the sheet near the second end for securing the second end to the boat, the securing lines being sufficiently long that, when the protector is in position on a boat, the securing lines can extend rearwardly and upwardly to anchor points that are on the boat distal from the sheet such that the sheet is held tightly against the hull of the boat by the engaging pocket and the securing lines.

5. The boat hull protector of claim 4 further including floats attached to the securing lines distal from the sheet, such that the lines may be easily retrieved and secured to the boat after the second end of the sheet has been pulled under the boat.

6. A method of protecting the bow end of a boat hull, the method comprising:

providing a sheet having a first end, a second end, a top surface, and a bottom surface, the sheet defining a prow-receiving pocket that opens toward the second end, the pocket being adapted to receive and engage the prow of a boat, a weight attached near the second end, a forward-opening scoop pocket at the bottom surface of the sheet near the second end, and securing lines attached to the sheet near the second end;

placing the sheet over the prow of the boat while the boat is floating in water so that the prow is received in the prow-receiving pocket;

dropping the second end of the sheet into the water below the prow, such that the weight causes the second end to sink;

propelling the boat forward, such that a scoop pocket is filled with water and drags the second end beneath the boat toward the stern;

retrieving the lines from the water;

securing the lines to the boat, such that the lines pull upwardly and toward the stern of the boat to secure the protector sheet to the underside of the bow of the boat.

7. The method of claim 6 further comprising:

providing a tightening line having free portions which extend from each side of the pocket; and attaching the free portions of the tightening line to one or more cleats on the boat, such that the sheet fits tightly against the boat.

8. The method of claim 6 wherein floats are attached to the lines distal from the sheet, such that a portion of each line is held at the surface of the water while the sheet is pulled under the boat so that the lines can be easily retrieved.

9. A boat hull protector comprising:

a sheet for covering the bow end of the boat hull, the sheet having a first end, a second end, a top surface, and a bottom surface, the sheet defining a prow-receiving pocket that opens toward the second end, the pocket being adapted to receive and engage the prow of the boat;

fasteners attached to the sheet near the second end for securing the second end to the boat, such that the sheet is held tightly against the hull of the boat by the engaging pocket and the fasteners; and a scoop pocket at the bottom surface of the sheet near the second end, the pocket being forward-opening such that when the boat moves forward with the prow of the boat received in the prow-receiving pocket, the scoop pocket is filled with water, and pulls the second end toward the stern end of the boat.

* * * * *